US005361573A

United States Patent [19]

Fehrer

[11] Patent Number: 5,361,573

[45] Date of Patent: Nov. 8, 1994

[54] TRAVELER ARRANGEMENT IN RING SPINNING APPARATUS

[76] Inventor: Ernst Fehrer, Auf der Gugl 28, A-4020 Linz, Austria

[21] Appl. No.: 60,225

[22] Filed: May 11, 1993

[30] Foreign Application Priority Data

May 14, 1992 [DE] Germany ..... 4215883
Jan. 26, 1993 [AT] Austria ..... 117/93

[51] Int. Cl.[5] ..... D01H 1/42; D01H 7/18

[52] U.S. Cl. ..... 57/354; 57/75; 57/352

[58] Field of Search ..... 57/75, 121, 124, 137, 57/352, 354, 355, 356, 122

[56] References Cited

U.S. PATENT DOCUMENTS 765,596 7/1904 Rossetti ..... 57/75
3,683,612 8/1972 Buzano ..... 57/75 X

FOREIGN PATENT DOCUMENTS 877710 12/1942 France ..... 57/354
3909673 10/1989 Germany ..... 57/354
13269 of 1905 United Kingdom ..... 57/354

*Primary Examiner*—Daniel P. Stodola
*Assistant Examiner*—William Stryjewski
*Attorney, Agent, or Firm*—Collard & Roe

[57] ABSTRACT

A ring spinning apparatus, which comprises a rotatably drivable spindle, which is adapted to carry and to be non-rotatably connected to a bobbin, a guide ring, which is coaxial to the axis of the spindle and serves to guide a traveler, which is adapted to revolve on the guide ring and constitutes a yarn guide, and an annular deflecting guide, which surrounds the bobbin and serves to deflect adjacent to the guide ring the yarn which is approaching the traveler. That ring spinning apparatus is characterized in that the projections of that yarn portion which is approaching the traveler from the deflecting guide and that yarn portion which is departing from the traveler in a plane that extends through the axis of the spindle include an angle that is smaller than 90° and the projections of said approaching and departing yarn portions in a plane that is at right angles to the axis of the spindle include an angle that is larger than 90°.

4 Claims, 2 Drawing Sheets

TRAVELER ARRANGEMENT IN RING SPINNING APPARATUS

BACKGROUND OF THE INVENTION

1. Field of the Invention

This invention relates to a ring spinning apparatus comprising a spindle, which is adapted to be driven to rotate about its axis and to carry a bobbin, that is non-rotatably connected to said spindle, a guide ring, which is coaxial to the axis of the spindle and serves to guide a traveler, which is adapted to revolve on the guide ring and comprises a yarn guide, and a deflecting guide, which surrounds the bobbin and serves to deflect adjacent to the guide ring the yarn which is moving toward the traveler.

2. Description of the Prior Art

In ring spinning apparatuses a roving is withdrawn from a drawing frame and is delivered via a ring spinning guide to a bobbin, which is non-rotatably mounted on a driven spindle, which is driven to rotate about its axis. The ring spinning guide usually consists of a traveler, which revolves on a guide ring concentrically about the bobbin and has two legs, which embrace the orbit of the traveler and which by said legs is fitted on the ring. The traveler constitutes an eye for guiding the yarn as it is moving toward the bobbin so that the yarn departing from the traveler toward the rotating bobbin carries the traveler along around the bobbin. Each revolution of the traveler imparts a twist to the yarn and the speed difference between the leading bobbin and the lagging traveler determines the speed at which the yarn is wound up. Centrifugal forces act on the traveler, on the one hand, and on the yarn being formed, on the other hand, and in conjunction with the guiding forces cause a tilting moment to be exerted on the traveler in a direction which is transverse to the orbit of the traveler. This results in a higher friction and in case of a high speed of the traveler in a non-permissible heat loading in continuous operation. To improve the orientation of the sliding traveler relative to the guide ring, it has already been suggested to provide adjacent to that guide ring an annular guide, which surrounds the bobbin and serves to deflect the yarn. The yarn is so deflected by that deflecting guide that an acute angle is included between the approaching and departing yarn portions adjacent to the traveler. Owing to that course of the yarn, the tension of the yarn exerts on the traveler a centripetal force, which opposes the tilting moment that is due to centrifugal force, and an improved orientation of the sliding traveler is thus ensured. But that acute angle between the yarn portions which approach and depart from the traveler imposes an additional load on the yarn because the yarn may possibly be deflected around a sharp edge adjacent to the traveler and this may result in an undesired roughening of the yarn and in an increased risk of yarn breakage, particularly when the traveler is revolving at a high velocity. In that case the advantages regarding the orientation of the sliding traveler which are due to the additional deflection of the yarn cannot be utilized.

SUMMARY OF THE INVENTION

For this reason it is an object of the invention so to improve by the use of simple means a ring spinning apparatus of the kind described first hereinbefore that an adverse affect on the quality of the yarn need not be feared even if the traveler is revolving at high speed.

The object set forth is accomplished in accordance with the invention in that the projections of that yarn portion which is approaching the traveler from the deflecting guide and that yarn portion which is departing from said traveler in a plane that extends through the axis of the spindle include an angle that is smaller than 90° and the projections of said approaching and departing yarn portions in a plane that is at right angles to the axis of the spindle include an angle that is larger than 90°.

Because the yarn portion departing from the traveler toward the bobbin extends essentially in a plane which is at right angles to the axis of the spindle, all straight lines which are at right angles to said departing yarn portion and intersect the departing yarn portion in one point define a plane, the projection of which on a plane that is at right angles to the spindle axis is a straight line that is at right angles to the departing yarn portion. As a result, the yarn portion departing from the traveler will include an angle that is larger than 90° with the yarn portion approaching the traveler if the angle included by the projections of the yarn portion approaching the traveler and of the yarn portion departing from the traveler include an angle that is larger than 90°. By that condition it will be ensured that the actual angle between the yarn portions which approach and depart from the traveler is larger than 90°, which is an essential requirement for a gentle deflecting of the yarn. Nevertheless the traveler will be subjected to desirable load conditions because the centrifugal forces will be opposed only by those components of the forces exerted by the yarn which lie in the plane extending through the axis of the spindle and the resultant force which is exerted by the yarn and opposes said centrifugal forces will be determined by the projections of the yarn portions approaching and departing from the traveler in the plane which extends through the axis of the spindle and in which the projections of said yarn portions include an acute angle with each other.

If the angle between the projections of the yarn portions approaching and departing from the traveler in the plane extending through the axis of the spindle is between 50° and 60°, particularly desirable conditions regarding the orientation of the sliding traveler will be obtained in most applications so that the traveler will have a long useful life even if it revolves at a high speed and the quality of the yarn will not adversely be affected in that case.

The angle between the projections of the yarn portions approaching and departing from the traveler in a plane that is at right angles to the axis of the spindle is essentially determined by the braking action exerted by the deflecting guide on the yarn which is revolving along that deflecting guide. The stronger that braking action, the larger will be the angle actually included between the yarn portions approaching and departing from the traveler. For this reason that angle may also be influenced by the friction conditions adjacent to the deflecting guide. But the roughness of the sliding surface of the deflecting guide must not effect an additional roughening of the yarn and for this reason the braking action on the revolving yarn may mainly be changed by a change of the length in which the yarn is in contact with the deflecting guide. It has been found in practice that particularly desirable conditions in this respect will be obtained if the deflecting guide has for contacting the yarn approaching the traveler a sliding surface having in the axial direction a height which is at least as large as one-half of the radius and preferably at least as large as the radius of the deflecting guide.

DETAILED DESCRIPTION OF THE PREFERRED EMBODIMENT

Figure 1:
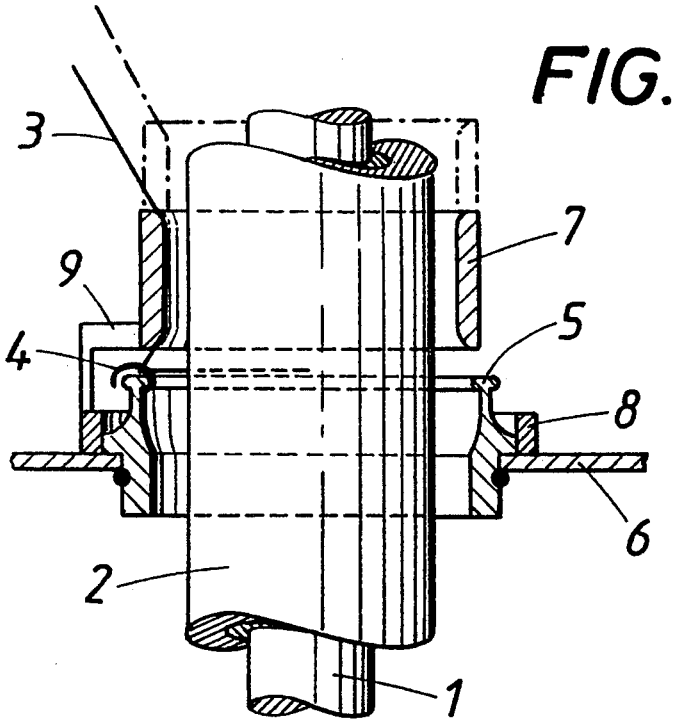
FIG. 1 is a schematic axial sectional view showing a ring spinning apparatus in accordance with the invention.
Figure 2:
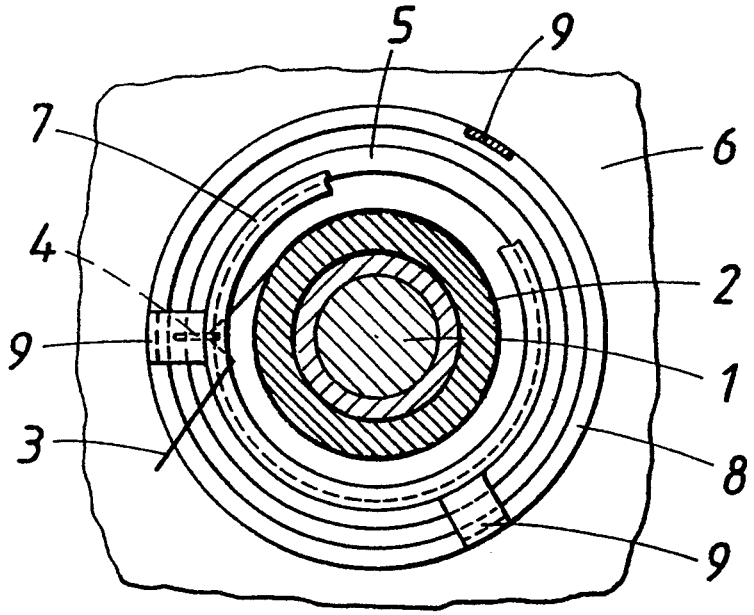
FIG. 2 is a top plan view, partly torn open, which shows that ring spinning apparatus.

An illustrative embodiment of the invention will now be described more in detail with reference to the drawing.

The illustrated ring spinning apparatus comprises a spindle 1, which is driven in conventional manner and on which a bobbin 2 is non-rotatably mounted. The yarn 3 to be made from a drawn fibrous roving is supplied to the bobbin via a traveler 4, which constitutes an eyelet for guiding the yarn and which revolves on a guide ring 5. That guide ring 5 is inserted in the conventional manner in a ring rail 6. At a small axial distance above the guide ring 5 the bobbin 2 is surrounded by deflecting guide 7, which consists of a slide ring, which is smaller in inside diameter than the guide ring 5. That deflecting guide 7 is supported by an annular holder 8, which is mounted on the body of the guide ring 5 and carries curved retaining elements 9, to which the deflecting guide 7 is secured.

Figure 3:
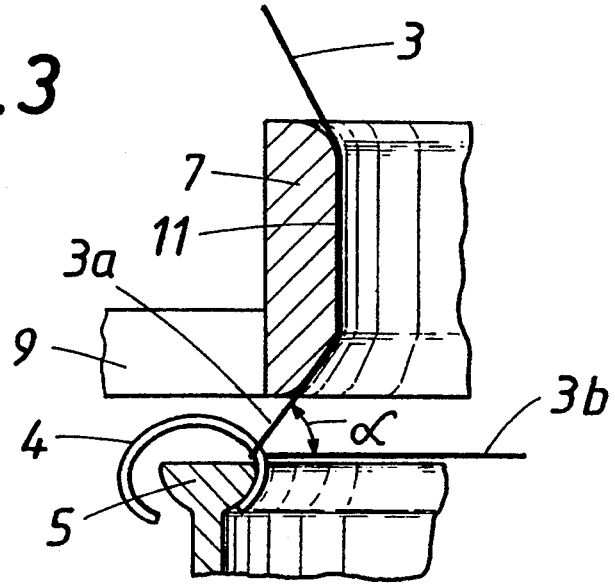
FIG. 3 is an axial sectional view taken on a plane extending through the guide ring and showing on a larger scale the course of the yarn adjacent to the traveler.

The yarn 3 which has been deflected by the deflecting guide 7 is approaching the traveler 4 along such a path that the angle $\beta$ between the approaching yarn portion 3*a* projected onto a plane extending perpendicularly to the axis and the yarn portion 3*b* departing from the traveler in that plane is larger than 90°, provided that the projections of said yarn portions 3*a* and 3*b* in a plane extending through the axis of the spindle include an angle $\alpha$ that is smaller than 90°. That acute angle $\alpha$ in the plane of FIG. 3 is preferably between 50° and 60° and is determined by the geometric relationship between the deflecting guide 7 and the guide ring 5.

Figure 4:
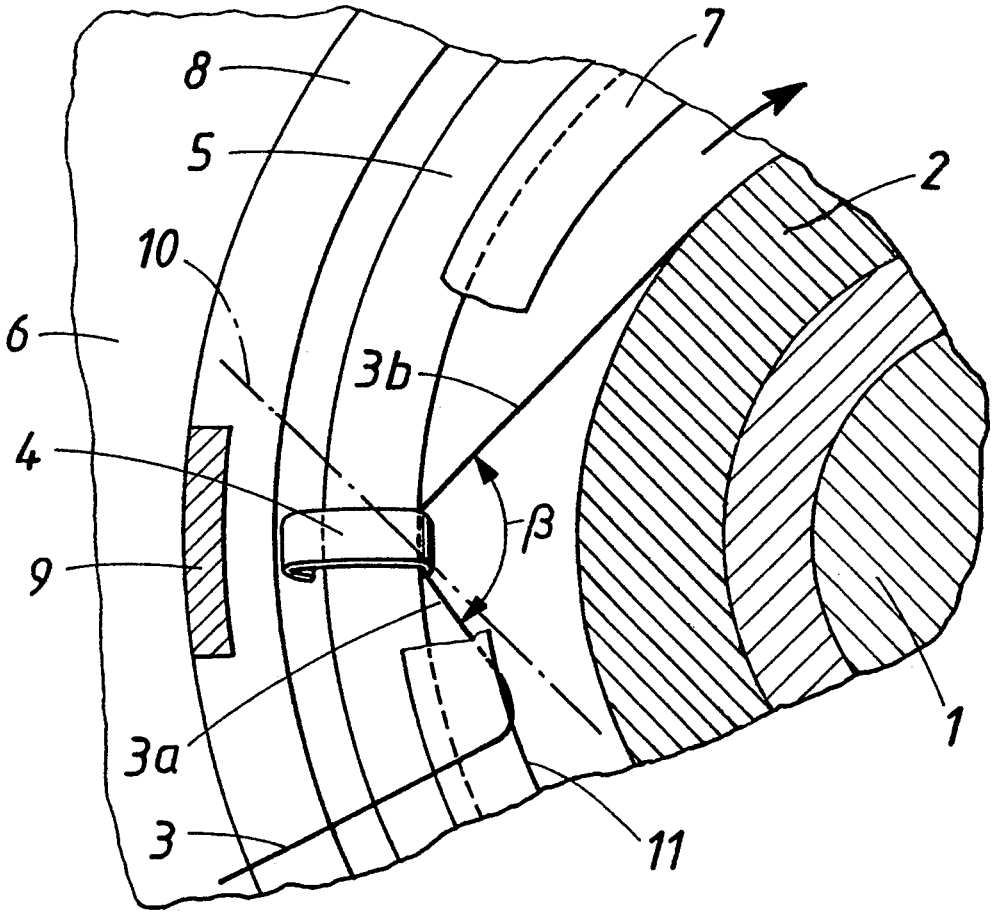
FIG. 4 is a top plan view, which is partly torn open and shows on a larger scale the course of the yarn in the region shown in FIG. 3.

The plane of FIG. 4 corresponds to a projection plane that is at right angles to the axis of the spindle. All straight lines extending perpendicular to the departing yarn portion 3*b* and intersecting said yarn portion 3*b* in one point define a plane extending perpendicularly to the yarn portion 3*b*, the projection of which on the plane extending perpendicular to the axis of the spindle is a straight line extending perpendicularly to the yarn portion 3*b* and shown in phantom at 10 in FIG. 4. For this reason any angle $\beta$ which is included by the projections of the approaching yarn portion 3*a* and the departing yarn portion 3*b* in the projection plane of FIG. 4 will be larger than 90° if the angle between the approaching yarn portion 3*a* and the departing yarn portion 3*b* exceeds 90° and the requirement that the angle $\beta$ must be larger than 90° ensures that the actual angle between the yarn portions 3*a* and 3*b* exceeds 90°. In case of such a larger angle of deflection at the traveler 4 the loads on the yarn will be much smaller than in case of an acute angle of deflection so that the risk of an additional roughening of the yarn will be avoided. Besides, the tilting moment acting on the traveler in the direction in which it is revolving can be reduced because, as is shown in FIG. 4, the angle bisector between the projections of the two yarn portions 3*a* and 3*b* in the plane which is at right angles to the axis of the spindle approaches the radial direction.

The angle $\beta$ is determined by the braking action which in the direction in which the traveler is revolving is exerted on the yarn portion 3*a* which is approaching the traveler 4. That braking action may be influenced by the friction condition and care must be taken that the yarn is not additionally roughened. For this reason the sliding surface 11 of the deflecting guide 7 should have only a small roughness. In order to ensure that the friction forces will nevertheless be sufficient, the axial height of the sliding surface in contact with the yarn may be sufficiently large. If that height is at least as large as one-half of the inside radius of the deflecting guide 7 and preferably at least as large as the said inside radius, as shown in FIG. 1, the braking action exerted on the yarn 3 revolving along the deflecting guide 7 will generally be satisfactory so that said yarn will sufficiently lag behind the traveler 4.

I claim:

1. A ring spinning apparatus comprising (a) a spindle mounted to be rotatable about an axis extending in a longitudinal direction and adapted to be driven to rotate about the axis, (b) a bobbin non-rotatably connected to, and carried by, the spindle, (c) an annular deflecting guide surrounding the spindle and adapted to receive a yarn and to deflect the yarn, (d) a guide ring centered on the axis and arranged axially adjacent the deflecting guide, (e) a traveler slidably mounted on the guide ring and adapted to revolve on the guide ring about the axis, (1) the traveler being adapted to receive an approaching portion of the yarn deflected by the deflecting guide and to deliver a departing portion of the yarn to the bobbin, (2) the approaching and departing yarn portions projected onto a plane extending through the axis including an angle $\alpha$ that is smaller than 90°, and (3) the approaching and departing yarn portions projected onto a plane extending perpendicularly to the axis including an angle $\beta$ that is larger than 90°.

2. The ring spinning apparatus of claim 1, wherein the angle $\alpha$ is between 50° and 60°.

3. The ring spinning apparatus of claim 1, wherein the deflecting guide has a sliding surface adapted to be slidingly contacted by the received yarn and extending in the longitudinal direction of the axis, the sliding surface having a height that is at least equal to one-half the inside radius of the deflecting guide.

4. The ring spinning apparatus of claim 3, wherein the sliding surface has a height that is at least equal to the inside radius.

* * * * *